US006438934B1

(12) United States Patent
Foster et al.

(10) Patent No.: US 6,438,934 B1
(45) Date of Patent: Aug. 27, 2002

(54) APPARATUS AND METHOD FOR FABRICATION OF TEXTILES

(75) Inventors: Peter William Foster, Alderley Edge; Duncan Cameron Ferrier, Tiverton; Ujithe Sujeewa Wickramasinghe Gunasekera, Manchester, all of (GB)

(73) Assignee: University of Manchester Institute of Science and Technology (GB)

( * ) Notice: Subject to any disclaimer, the term of this patent is extended or adjusted under 35 U.S.C. 154(b) by 0 days.

(21) Appl. No.: 09/513,595

(22) Filed: Feb. 25, 2000

Related U.S. Application Data

(63) Continuation-in-part of application No. 09/356,687, filed on Jul. 20, 1999, now Pat. No. 6,139,588, which is a continuation of application No. 08/737,653, filed as application No. PCT/GB95/01170 on May 23, 1995, now Pat. No. 5,931,972.

(30) Foreign Application Priority Data

| | | |
|---|---|---|
| May 24, 1994 | (GB) | 9410379 |
| Jul. 8, 1999 | (GB) | 9915922 |
| Jul. 8, 1999 | (GB) | 9915923 |
| Jul. 8, 1999 | (GB) | 9915924 |

(51) Int. Cl.[7] ..... D01H 13/26

(52) U.S. Cl. ..... 57/328; 57/264; 57/289; 57/333; 57/350

(58) Field of Search ..... 57/328, 264, 293, 57/289, 58.49, 333, 350

(56) References Cited

U.S. PATENT DOCUMENTS

| | | | | |
|---|---|---|---|---|
| 3,061,941 A | | 11/1962 | Goy et al. | |
| 3,175,375 A | | 3/1965 | Yazawa et al. | |
| 3,213,470 A | | 10/1965 | Yazawa et al. | |
| 3,241,343 A | | 3/1966 | Yazawa | |
| 3,320,776 A | | 5/1967 | Gorodissky et al. | |
| 3,349,578 A | | 10/1967 | Greer et al. | |
| 3,563,064 A | | 2/1971 | Yazawa | |
| 3,727,392 A | * | 4/1973 | Gibbon | 57/333 |
| 3,783,649 A | | 1/1974 | Yamamoto et al. | |
| 3,822,543 A | * | 7/1974 | Edagawa et al. | 57/328 X |
| 3,851,457 A | * | 12/1974 | Waters | 57/293 X |
| 3,927,540 A | | 12/1975 | Tanaka et al. | |
| 3,965,511 A | | 6/1976 | Fleissner | |
| 4,003,195 A | * | 1/1977 | Fernstrom et al. | 57/293 |
| 4,138,840 A | * | 2/1979 | Greenway et al. | 57/289 |
| 4,148,179 A | * | 4/1979 | Becker et al. | 57/350 |
| 4,173,861 A | * | 11/1979 | Norris et al. | 57/293 |
| 4,226,092 A | | 10/1980 | Lüthi | |
| 4,286,394 A | | 9/1981 | Gort | |
| 4,384,448 A | * | 5/1983 | Wilkie | 57/200 |
| 4,408,445 A | * | 10/1983 | Wilkie | 57/246 |
| RE31,705 E | * | 10/1984 | Morihashi | 57/224 |
| 4,586,934 A | | 5/1986 | Blalock et al. | |
| 4,624,102 A | * | 11/1986 | Bell, Jr. | 57/296 |
| 4,870,813 A | * | 10/1989 | Nelson | 57/204 |
| 5,003,763 A | * | 4/1991 | Hallam et al. | 57/297 |
| 5,193,335 A | * | 3/1993 | Mori | 57/296 |
| 5,287,606 A | | 2/1994 | Ruef | |
| 5,404,706 A | | 4/1995 | Ueno et al. | |
| 5,709,910 A | | 1/1998 | Argyle et al. | |
| 5,802,832 A | * | 9/1998 | Foster | 57/290 X |

FOREIGN PATENT DOCUMENTS

| | | | | |
|---|---|---|---|---|
| DE | 24 30 741 | | 1/1975 | |
| DE | 4102790 | * | 8/1991 | 57/289 |
| FR | 2 246 678 | | 5/1975 | |
| GB | 1581827 | * | 12/1980 | 57/333 |
| JP | 122840 | * | 10/1978 | 57/289 |
| WO | WO 97/30200 | | 8/1997 | |
| WO | WO 97/38306 | | 10/1997 | |

* cited by examiner

*Primary Examiner*—Rodney M. Lindsey
(74) *Attorney, Agent, or Firm*—Wallenstein & Wagner, Ltd.

(57) ABSTRACT

A method and apparatus are disclosed for fabrication of textiles. The method includes the step of passing a yarn or product along a path through a device. The method also includes applying a rotation force to the yarn or product with at least one jet of liquid directed by the device.

128 Claims, 4 Drawing Sheets

APPARATUS AND METHOD FOR FABRICATION OF TEXTILES

RELATED APPLICATIONS

This application is a continuation in part of U.S. patent application Ser. No. 09/356,687, filed Jul. 20, 1999 now U.S. Pat. No. 6,139,588, which is a continuation of U.S. patent application Ser. No. 08/737,653, filed Nov. 22, 1996, now U.S. Pat. No. 5,931,972, which claims priority under 35 U.S.C. §119 and 37 C.F.R. §1.55 which is a 371 of International Application No. PCT/GB95/01170 filed May 23, 1995; Great Britain Patent Application Serial No. 9410379.3, filed May 24, 1994; Great Britain Patent Application Serial No. 9915924.6, filed Jul. 8, 1999; Great Britain Patent Application Serial No. 9915923.8, filed Jul. 8, 1999; and Great Britain Patent Application Serial No. 9915922.0, filed Jul. 8, 1999.

This application also is related to a co-pending U.S. Patent Application entitled "Apparatus and Method for Texturing Yarn," Ser. No. 09/513,802, filed on Feb. 25, 2000, having the same common assignee, and incorporated herein by reference.

TECHNICAL FIELD

The present invention relates to an apparatus and method for fabrication of textiles or the like, and in particular to the use of liquid jets to false twist textile filament yarns and twist textile staple products such as yarn, sliver or roving.

BACKGROUND OF THE INVENTION

It is known to apply a twist to a textile staple product to give the product satisfactory coherence by passing the product through a twisting jet in which a jet or jets of air are directed onto the traveling product offset from its axis to impart a twisting torque to the product. The diameter of a textile product is relatively small, for example jet manufacture are extremely tight if satisfactory processing is to be achieved and consistency of performance from jet to jet. Typically, a textile machine for performing such a process can have over 200 processing stations, i.e., over 200 yarns are processed simultaneously in parallel threadlines. This means that the machines are very large, which leads to problems of ergonomics. Furthermore, the provision of tight tolerance texturing jets and high pressure air to such jets is expensive and such a machine is very noisy, particularly when one or more doors of the jet boxes are open for threading purposes.

It has also been proposed to use a texturing jet to apply a false twist to a textile filament yarn. This proposed method consists of passing the yarn through a texturing jet wherein, like the twisting jet described above, a jet or jets of air are directed onto the traveling yarn offset from its axis to impart a twisting torque to the yarn. The twist levels achievable by this method are very low by comparison with those achieved by the use of friction discs, belts and the like, hence the limited use commercially. The tolerances on this type of air jet manufacture are especially tight since the diameter of a textile yarn, for example 0.2 mm for 150 Denier, is even smaller than when using an air jet to apply a twist to a textile staple product. In addition, since from a production costs point of view it is desirable to increase the yarn processing speed as much as possible, a limit on such speed is the surge speed, the speed at which satisfactory processing breaks down due to the long uncontrolled lengths of yarn in the machine.

SUMMARY OF THE INVENTION

The present invention provides a method of applying twist to a textile product comprising passing the product along a path through a device while applying a rotational force to the product with at least one jet of liquid directed by the device.

The method can also comprise applying a forwarding force to the product. The method can comprise applying at least one axially offset jet of liquid to the surface of the product. The method can comprise applying the at least one jet of liquid with components of velocity both along and laterally of the path through the jet device. The method can comprise applying a plurality of jets of liquid disposed about the path through the jet device, which jets can be symmetrically disposed. Preferably, three such jets of liquid are provided. Preferably the liquid is water and can be cold water. The method can also comprise passing the product successively through a plurality of liquid jet devices. Consecutive jet devices can apply rotational forces to the product in the same or in opposite directions.

The invention also provides a process, in which a twist is applied to the product by the above method, comprising controlling the product by a feedback arrangement. In this case, a property of the product can be measured and the measurement used to control the product processing. The measurement can be used to control the liquid jet device or the product speed.

The process can comprise cooling the product. The product can be cooled by the liquid jet device.

The invention can also comprise an apparatus for applying twist to a textile product comprising a liquid jet device adapted to apply a rotational force to a product traveling along a path through the jet device.

The liquid jet device can be adapted to apply a forwarding force to the traveling product. The jet device can apply at least one axially offset jet of liquid to the surface of the product. The at least one jet of liquid can be directed to have velocity components both along and laterally of the path through the jet device. A plurality of jets can be disposed about the path. through the jet device, preferably symmetrically. Three such jets can be provided. The liquid jet device can comprise a housing having an axial bore terminating in a product constricting outlet, the axis of the bore defining a path therethrough, with at least one liquid flow channel aimed towards the outlet and offset from the axis. The liquid jet device can comprise a casing having at least one seal against liquid escape along the path. The seal can be a labyrinth seal and can be pressurized. The seal can be gas pressurized, and can be pressurized by compressed air. Preferably the liquid jet device comprises a water jet device. A plurality of liquid jet devices can be disposed successively along the path, and the plurality of jet devices can be provided in a common casing. Three such jet devices can be so provided. Consecutive liquid jet devices can be adapted to apply rotational forces to the product in the same or in opposite directions.

The apparatus can comprise a feedback arrangement operable to control the product processing. The feedback arrangement can comprise a measuring instrument operable to measure a property of the product and produce a signal proportional to the measurement, and control means operable in response to the signal to control the product processing. The control means can be operable to control the rate or the pressure of the flow of liquid to the liquid jet device or the product speed.

The apparatus can comprise cooling apparatus, which can comprise the liquid jet device. The apparatus can also comprise winding apparatus disposed downstream of the liquid jet device.

The present invention also provides a method of applying a false twist to a textile filament yarn comprising passing the yarn along a yarn path while applying a rotational force to the yarn by a liquid jet device.

The invention also provides a process for applying twist to a filament yarn, in which the false twist is applied to the yarn by the above method and the yarn is cooled. The yarn can be cooled by the liquid jet device. The yarn can be heated prior to being cooled and twisted, and can then be wound up. The yarn can be passed through a twist trap, a heating zone, a cooling zone and the liquid jet device, being twisted by the latter so that the twist runs back to the twist trap, and then wound up. The yarn can be heated as far upstream as the twist trap. The yarn can be heated prior to passing through the twist trap and not further heated between the twist trap and the liquid jet device. The yarn can be drawn prior to being cooled and twisted.

The yarn can be cooled by immersion in a cooling liquid, in which case the cooling liquid can be moved in contraflow to the yarn passing through the cooling zone. The cooling zone and the liquid jet device can be contiguous. The cooling liquid can be the liquid of the jet device. The process can comprise heating the yarn by vapor, which can be superheated steam.

The yarn can be post-treated prior to it being wound up. In this case, the yarn can be passed with controlled overfeed through heating apparatus. The heating apparatus can comprise vapor heating, which can be superheated steam.

The invention can also comprise an apparatus for applying twist to a textile filament yarn comprising a liquid jet device adapted to apply a rotational force to a yarn traveling along a yarn path through the jet device.

The apparatus can also comprise a yarn heating apparatus, which can be upstream of the cooling apparatus. The apparatus can comprise winding apparatus disposed downstream of the liquid jet device. The apparatus can also comprise drawing means, which can be disposed upstream of the cooling apparatus. The heating apparatus, cooling apparatus and liquid jet device can be mounted in a common housing.

The yarn cooling apparatus can be a fluid cooling apparatus in which the yarn passes through a fluid to be cooled by heat transfer thereto. The yarn cooling apparatus can comprise a cooling chamber with a fluid inlet and a fluid outlet for cooling fluid to be passed therethrough, and a yarn inlet and yarn outlet. The cooling fluid can be passed contraflow relative to the yarn. The cooling chamber can comprise seals against escape of cooling fluid at the yarn inlet and the yarn outlet. The seals can be labyrinth seals and can be pressurized. The seals can be gas pressurized, and can be pressurized by compressed air. The cooling fluid can be a liquid and can be water. The flow of liquid through the cooling chamber can be arranged to be turbulent. The liquid jet device and the cooling apparatus can have a common liquid.

The heating apparatus can comprise a vapor heating apparatus. The vapor can be superheated steam. The heating apparatus can comprise a housing having seals against escape of steam at a yarn inlet and at a yarn outlet thereof The seals can be labyrinth seals and can be pressurized. The seals can be gas pressurized, and can be pressurized by compressed air or by superheated steam. The heating apparatus, the cooling apparatus and the liquid jet device can be disposed in a common housing.

The apparatus can also comprise treatment means operable to post treat the yarn. In this case, the apparatus can comprise feed means operable to pass the yarn with controlled overfeed through a further heating apparatus. The further heating apparatus can be a vapor heating apparatus. The heating apparatus and the further heating apparatus can use the same vapor in sequence.

Other features and advantages of the invention will be apparent from the following specification taken in conjunction with the following drawings.

BRIEF DESCRIPTION OF THE DRAWINGS

The invention will now be described with reference to the accompanying drawings in which.

DETAILED DESCRIPTION OF THE PREFERRED EMBODIMENT

Figure 1:
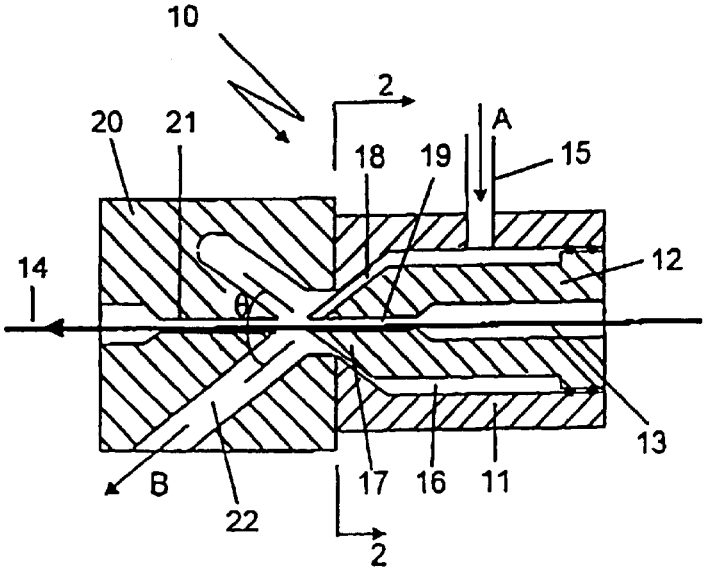
FIG. 1 is a section on the line 1—1 of FIG. 2 of a liquid jet device.
Figure 2:
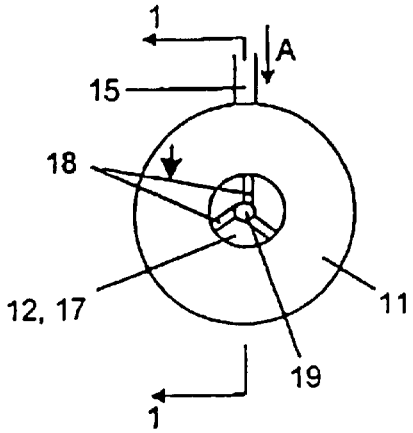
FIG. 2 is a section on the line 2—2 of FIG. 1 of the liquid jet device.

Referring now to FIGS. 1 and 2, there is shown a liquid jet device 10 in the form of a cylindrical housing 11 having an insert 12 in which there is a stepped bore 13 defining an axial path for a textile filament yarn or textile staple product 14 to pass through the jet 10. A supply 15 supplies water or other suitable liquid in the direction of arrow A to the annular space 16 between the housing 11 and the insert 12. The downstream end of the insert 12 and the annular space 16 are of co-operating conical form. In the conical end 17 of the insert 12 are grooves 18 which are offset from the axis of the smaller diameter part 19 of the bore 13, three such grooves 18 being shown in this case symmetrically disposed around the yarn or product 14. The grooves 18, being offset from the axis of the bore 19, provide that the impinging jets of water subject the textile filament yarn or textile staple product to a torque that false twists a textile filament yarn or twist a textile staple product, respectively. The grooves 18, which can be straight as shown or can be formed spirally in the conical end 17, are directed at an angle to the direction of running of the yarn or product 14 so that the water jets have components of velocity along the path of the yarn or product 14 as well as laterally thereof This applies a forwarding force to the yarn or product 14 as well as the twisting torque. The flatter the cone 17, i.e., the greater the cone angle θ, the more is the twisting torque and the less is the forwarding force and vice versa. A drain tube or block 20 is attached to the housing 11 and has a bore 21 which is aligned with the bore 19, both of which bores 19, 21 have substantially the same diameter as that of the yarn or product 14 so as to prevent the egress of water therealong. The water preferentially exits from the drain tube or block 20 in the direction of arrow B through an outlet 22. Three such water outlets 22 can be provided in the drain tube or block 20, each substantially in alignment with one of the grooves 18.

Figure 3:
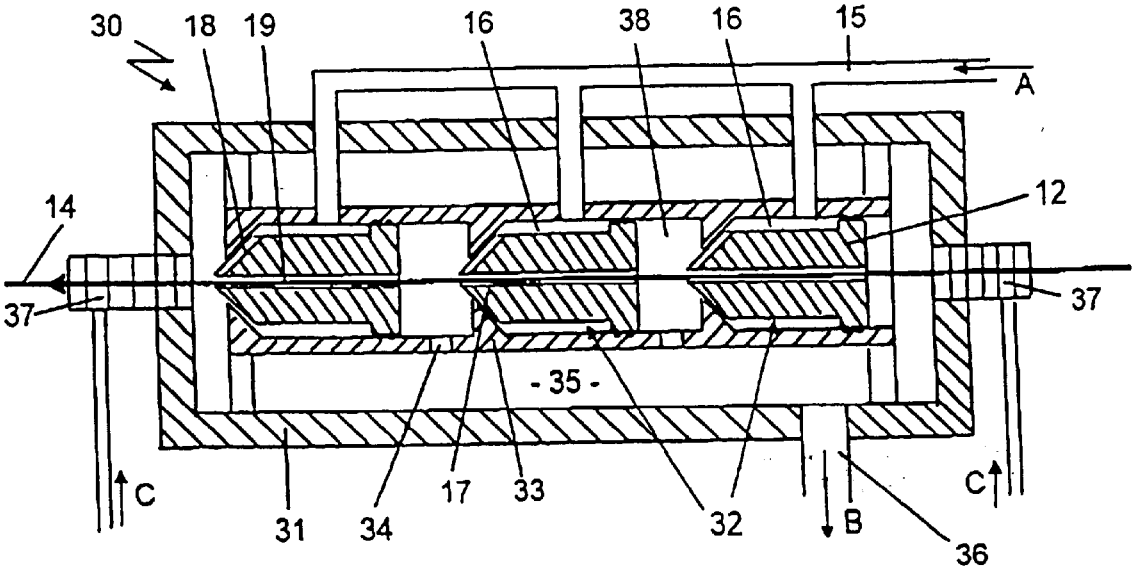
FIG. 3 is a section of a multi-head liquid jet device.

Referring now to FIG. 3, there is shown a multi-head twist unit 30. Within a housing 31 are three axially aligned liquid jet devices 32 similar to the type shown in FIGS. 1 and 2 and mounted in a casing 33. Parts of jet devices 32 corresponding with those of jet device 10 are identified by the same reference numerals. In the case of jet devices 32 however, the bores 19 are not stepped and extend the full length of the inserts 12. In addition, drain tubes or blocks 20 are omitted and the water, having impinged on the yarn or product 14 running successively through bores 19 of the three jet devices 32, exits from the casing 33 through drain holes 34 into the annular space 35 between the casing 33 and the housing 31. Water outlets 36 are provided in the housing 31, and in the case that the twist unit 30 is a "stand-alone" unit, labyrinth seals 37 are provided at each end of the housing 31. Compressed air is provided in the direction of arrows C to pressurize the seals 37 to prevent water egress from the housing 31 along the path of the yarn or product 14. The use of the multi-head apparatus 30 provides that each successive jet device 32 augments the twist in the yarn or product 14 inserted by the previous jet device 32. Alternatively, in twisting textile staple products such as yarn sliver or roving, the consecutive jet devices 32 can be arranged to impart opposite twist to the product 14, i.e., alternatively S and Z twist so that the resulting product 14 has alternative lengths of S and Z twist therein. The cone angles of the cones 17 of the three jet devices 32 can be progressively smaller whereby the first jet device 32 imparts more twisting torque and less forwarding force and the later jet devices 32 impart successively less twisting torque and greater forwarding force to the yarn or product 14.

Figure 4:
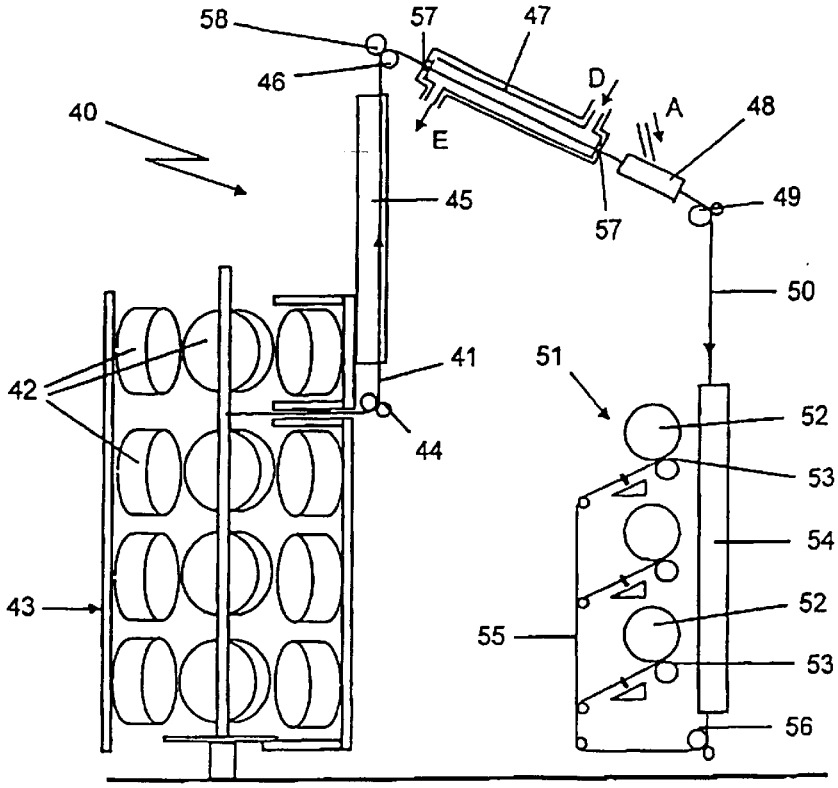
FIG. 4 is a threadline diagram of a false twist texturing machine incorporating the liquid jet device of FIGS. 1 and 2.

An embodiment of a false twist texturing machine arrangement 40 is shown in FIG. 4. Typically, the yarn 41 is partially drawn and is supplied on supply packages 42 mounted in a creel 43. The yarns 41 are withdrawn from the packages 42 by a first feed roller pair 44 and fed to a primary heater 45, and then around a guide roller 46 to a cooling device 47. From the cooling device 47 the yarn 41 passes through a false twist device 48 and a second feed roller pair 49. The false twist device 48 imparts a false twist to the yarn 41 which twist runs back to the first feed rollers 44, these acting as a twist stop device. The heating device 45 heats the twisted yarn 41 which retains the twist memory as it is cooled in the cooling device 47. The thus textured stretch yarn 50 can be passed directly to a take-up arrangement 51 in which it is wound onto a bobbin 52 driven by surface contact with a driving bowl 53. Alternatively, the textured yarn 50 can be passed through a setting or second heater 54 to become set yarn 55 before passing to the take-up arrangement 51. In this case, a third feed roller pair 56, which forwards the set yarn 55 to the take-up arrangement 51, is driven at a lower peripheral speed than that of the second feed rollers 49 so that the heating of the textured yarn 50 in the second heater 54 is at a controlled overfeed.

In the case of this invention, the false twisting device 48 is constructed and operates as the device 10 of FIGS. 1 and 2 or device 30 of FIG. 3, with water being introduced into the false twist device 48 in the direction of arrow A as described above. The cooling device 47 is a cylinder through which the heated yarn 41 passes and into which cooling water is introduced in the direction of arrow D and from which the water exits in the direction of arrow E. With this arrangement, the cooling water passes along the cooling device 47 in turbulent contraflow to the running yarn 41, both of which factors enhance the transfer of heat from the yarn 41 to the cooling water. At the opposed ends of the cooling device 47, the yarn inlet and yarn outlet are provided with seals 57 which can be pressurized against escape of water therethrough as shown and described in respect of seals 15, 37 of the false twist devices 10 and 30.

Conventionally, the heater 45 is a relatively long plate at a temperature close to the melting temperature of the yarn 41 and in contact with which the yarn 41 runs. Alternatively, to reduce the overall size of the machine 40, the primary heater can be a short non-contact heater at a temperature considerably higher than the melting temperature of the yarn 41. As an alternative, the roller 46 can be heated in order to heat the yarn 41 as it passes therearound. However, in this case, the primary heater 45 is a vapor heating chamber through which the yarn 41 runs, the preferred vapor being pressure steam. A further roller 58 is disposed to combine with the guide roller 46 to form the twist stop which inhibits twist from running upstream of the rollers 46, 58. The untwisted yarn 41 is more receptive to heat transfer than twisted yarn, so that the heater 45 can be smaller than even the short high temperature heaters referred to above. The peripheral speed of the rollers 46, 58 is greater than that of the first feed rollers 44 so that the heated yarn 41 is drawn between them. The yarn 41 is heated sufficiently by the steam in heater 45 prior to passing through the twist stop rollers 46, 58 that no further heating is required between the twist stop rollers 46, 58 and the false twist device 48. The heat in the yarn 41 is sufficient as it passes into the cooling device 47 for the yarn 41 to retain its twist memory. Due to the turbulent contraflow of cooling liquid in the cooling device 47, this cooling device 47 is shorter than conventional free-air or plate contact cooling arrangements.

Figure 5:
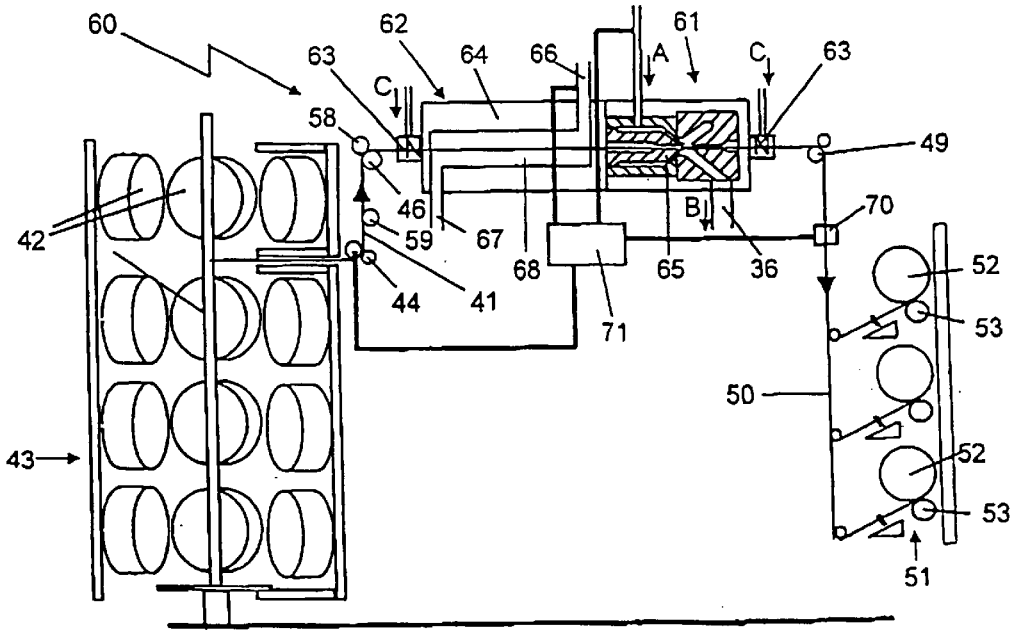
FIGS. 5 and 6 are alternative embodiments of the twisting machine.

Referring now to FIG. 5, there is shown a false twist texturing machine 60 having many of the components as described in respect of machine 40 of FIG. 4. Corresponding components are identified by the same reference numerals. In this machine arrangement, the heating, cooling and false twisting device are shown to be contiguous, and the heating for the drawing step between the first feed rollers 44 and the rollers 46, 58 is provided by a heated draw pin 59. The primary heating, cooling and false twisting device 61 comprises a housing 62 having labyrinth seals 63 at the entrance and exit for the yarn 41. The labyrinth seals 63 are pressurized, to prevent water egress from the interior of the housing 62, by compressed air supplied in the direction of arrows C. Within the housing 62 is, in sequence, a primary heating apparatus 64 and a cooling and twisting apparatus 65. The heating apparatus 64 has a steam inlet 66 and a steam outlet 67, the yarn 41 being heated by the steam as it passes along the bore 68 of the heating apparatus 64. The cooling and false twisting apparatus 65 shown is a single head apparatus 10 as shown in FIGS. 1 and 2, but preferably a multi-head apparatus 30 as shown in FIG. 3 is provided in order to increase the twist level imparted to the yarn 41. As the heated yarn 41 passes into the cooling and false twisting apparatus 65, it is first cooled, in a cooling zone 38 (see FIG. 3), due to the effect of the cold water passing through the apparatus 65. In this cooling zone 38, the cooling water passes in turbulent contraflow to the running yarn 41, both of which factors enhance the transfer of heat from the yarn 41 to the cooling water. The jets of water impinging laterally on the yarn 41 impart a false twist to the yarn 41. This twist runs back through the cooling zone 38 and heating apparatus 64 to the first feed rollers 44, these acting as a twist stop device. The heating device 64 heats the twisted yarn 41 which retains the twist memory as it is cooled in the cooling zone 38.

Another significant difference between the machines 40 and 60 is that in the case of machine 60 there is shown a measuring instrument 70 which measures a property of the stretch yarn 50. Such parameter can be elasticity or crimp modulus. The measuring instrument 70 sends a signal proportional to the value of the measured parameter to a controller 71 which compares that value with a predetermined desired value. If there is a discrepancy between the two values, the controller 71 is operable to control the rate and pressure of the water flow to the false twist apparatus 65, the speed of the feed rollers 44, 49 and/or the temperatures of the heating apparatus 64.

Figure 6:
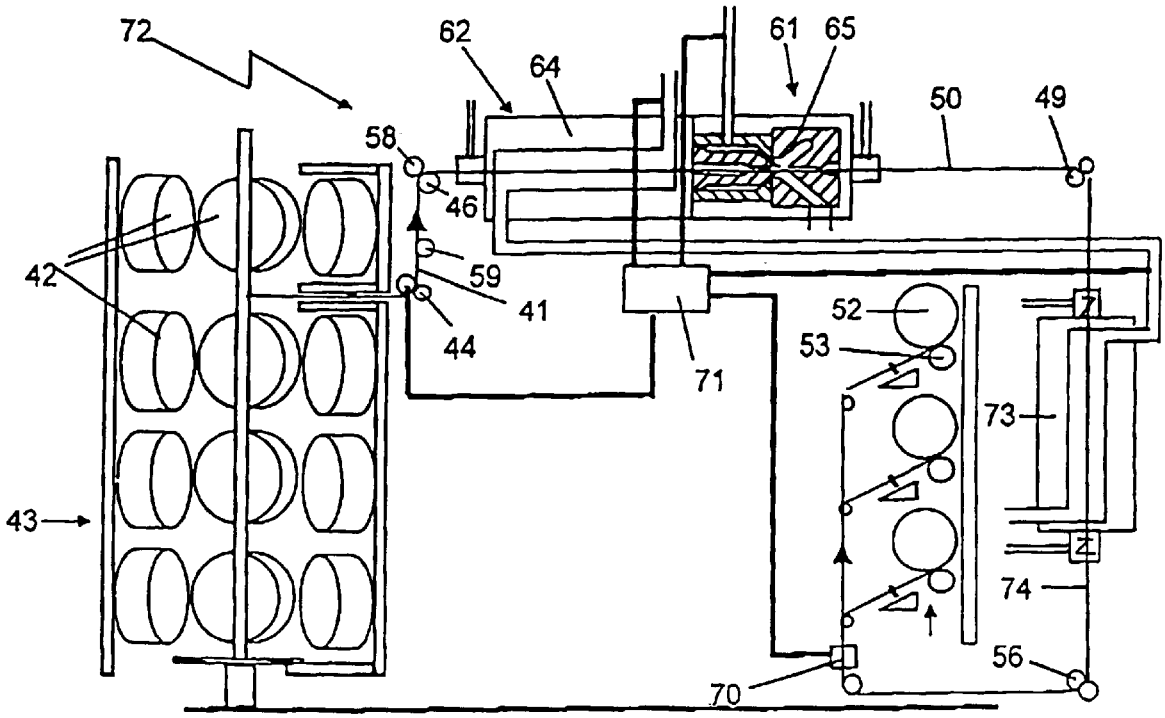

In FIG. 6 there is shown a machine 72 which is identical with machine 60 of FIG. 5 except that a second post treatment or setting heater 73 is provided. The textured yarn 50 runs through the secondary heater 73 under controlled overfeed conditions between second feed rollers 49 and third feed rollers 56 to receive its setting heating. The set yarn 74 then passes to the take-up arrangement 51. The steam issuing from the primary heater 64 is passed to the secondary heater 73, being further heated or cooled as required under the control of the controller 71 in response to the signal from the measuring instrument 70 which measures a parameter of the set yarn 74.

Although the embodiments of false twisting apparatus shown are fixed units, the individual jets of water can be individually mounted in the housing so that each is adjustable in respect of its spacing from the axis of the yarn to increase or decrease the twisting torque provided by a specific size of jet of water.

Figure 7:
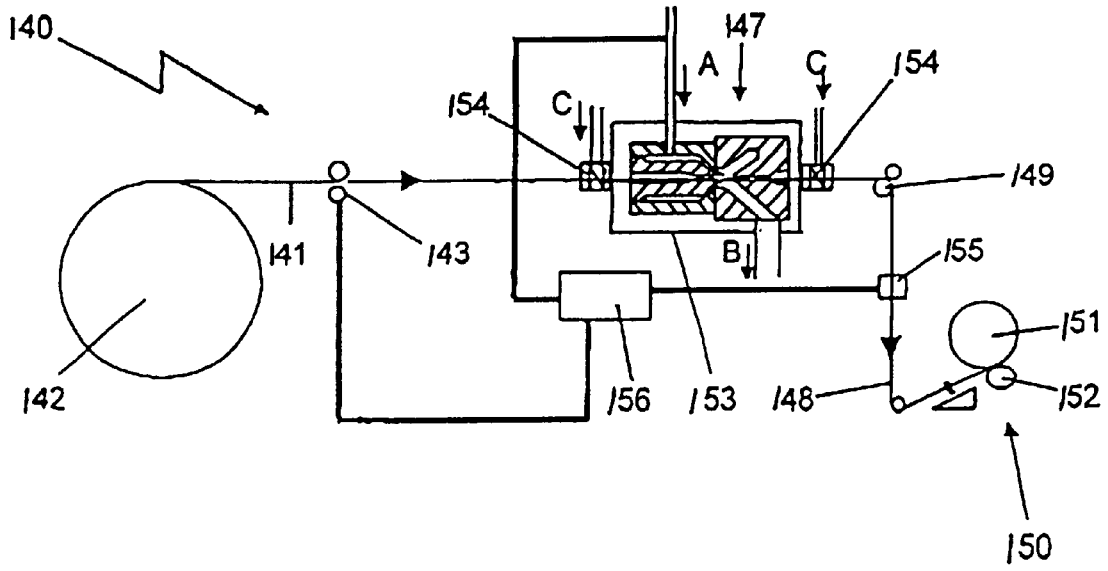
FIG. 7 is a threadline diagram of a staple twisting machine incorporating the liquid jet device of FIGS. 1 and 2.

A staple twisting and drawing machine arrangement 140 embodying the above described twisting device 10 is shown in FIG. 7 The supply of staple product 141 is provided in this case on a supply package 142, but the supply could be directly from a carding machine or other processing machine (not shown). The product 141 is withdrawn from the package 142 by a first feed roller pair 143. The product 141 is then forwarded to a twisting device 147. From the twisting device 147 the twisted staple product 148 passes via a second feed roller pair 149 to a take up arrangement 150 in which it is wound onto a bobbin 151 driven by surface contact with a driving bowl 152. The twist device 147 imparts a false twist to the product 141 which twist traps the staple fibers into the product 141 to give coherence to the twisted product 148.

In the case of this invention, the twisting device 147 is constructed and operates as the device 10 of FIGS. 1 and 2 or alternatively device 30 of FIG. 3, with water being introduced into the twisting device 147 in the direction of arrow A as described above. In this case, the twisting apparatus 147 shown is a single head apparatus 10 as shown in FIGS. 1 and 2, but preferably a multi-head apparatus 30 as shown in FIG. 3 is provided in order to increase the twist level imparted to the product 141 or provide alternate lengths of S and Z twisted product 141 depending on whether consecutive jet devices 32 (FIG. 3) are arranged to twist the product 141 in the same direction or in opposite directions. If the product 141 is in a heated condition as it passes into the twisting device 147 it can be cooled, in a cooling zone 38 (see FIG. 3), due to the effect of the cold water passing through the twisting device 147. In this cooling zone 38, the cooling water passes in turbulent flow around the running yarn 141, which enhances the transfer of heat from the yarn 141 to the cooling water. The water, after impinging o the product 141, leaves the casing 153 in the direction of arrow B, being prevented from escaping from the casing 153 along the path of the product 141 by labyrinth seals 154.

A measuring instrument 155 is provided to measure a property of the twisted staple product 148. Such parameter can be bulk or hairiness. The measuring instrument 155 sends a signal proportional to the value of the measured parameter to a control 56 which compares that value with a predetermined desired value. If there is a discrepancy between the two values, the controller 156 is operable to control the rate and/or pressure of the water flow to the twisting device 147, and/or the speed of the feed rollers 143 and 149.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

What is claimed is:

1. A method of manipulating a textile product comprising the steps of:

passing the product through a device having at least four openings and a bore with a longitudinal axis, applying a rotational force to the product with at least one jet of liquid directed by the device at an oblique angle to the product, maintaining the product in generally coaxial alignment with the longitudinal axis of the bore and discharging the liquid from at least one of the openings.

2. The method of claim 1 further comprising the step of applying a forwarding force to the product.

3. The method of claim 1 further comprising the step of axially offsetting the at least one jet of liquid relative to the surface of the product.

4. The method of claim 3 further comprising the step of directing the at least one jet of liquid to have components of velocity both along and laterally of the path through the device.

5. The method of claim 3 further comprising the step of applying a plurality of jets of liquid disposed about the path through the device.

6. The method of claim 5 further comprising the step of symmetrically disposing the plurality of jets about the path through the device.

7. The method of claim 5 further comprising the step of applying three jets of liquid symmetrically about the path through the device.

8. The method of claim 1 wherein the liquid is water.

9. The method of claim 1 further comprising the step of passing the product along a path through another device that directs at least one jet of liquid.

10. The method of claim 1 further comprising the step of passing the product along a path through another device that applies an additional rotational force to the product with at least one jet of liquid.

11. The method of claim 1 further comprising the step of passing the product along a path through another device that applies an opposite rotational force to the product with at least one jet of liquid.

12. The method of claim 1 further comprising the steps of applying a twist to the product and controlling the step of applying a twist to the product with a feedback arrangement.

13. The method of claim 12 further comprising the step of measuring a property of the twisted product and using the measurement to control the method of manipulating the textile product.

14. The method of claim 12 further comprising the steps of measuring a property of the twisted product and using the measurement to control the at least one jet of liquid.

15. The method of claim 12 further comprising the steps of measuring a property of the twisted product and using the measurement to control the passing of the product along the path through the device.

16. The method of claim 12 further comprising the step of cooling the product.

17. The method of claim 16 further comprising the step of cooling the product with the device.

18. An apparatus for manipulating a textile product comprising:

a jet device having at least four openings and a bore with a longitudinal axis, at least one jet of liquid directed by the device at an oblique angle to the product to apply a rotational force to the product as the product travels through the device while maintaining the product in generally coaxial alignment with the longitudinal axis of the bore, and at least one of the openings providing a dedicated liquid exhaust port and at least one of the other openings providing a dedicated liquid intake port.

19. The apparatus of claim 18 wherein the device applies a forwarding force to the product as the product travels through the device.

20. The apparatus of claim 18 wherein the device directs the at least one jet of liquid axially offset to the surface of the product.

21. The apparatus of claim 20 wherein the device directs the at least one jet of liquid to have components of velocity both along and laterally of the path through the device.

22. The apparatus of claim 20 wherein a plurality of jets of liquid are disposed about the path through the device.

23. The apparatus of claim 22 wherein the plurality of jets are symmetrically disposed about the path.

24. The apparatus of claim 23 wherein three jets are disposed symmetrically about the path.

25. The apparatus of claim 18 wherein the device includes a casing having an axial bore having an axis terminating in a product constricting outlet, the axis defining the path through the device, and at least one liquid flow channel aimed towards the outlet and offset from the axis.

26. The apparatus of claim 18 wherein the device includes a housing having at least one seal against liquid escape along the path.

27. The apparatus of claim 26 wherein the seal is a labyrinth seal.

28. The apparatus of claim 27 wherein the seat is pressurized.

29. The apparatus of claim 28 wherein the seal is gas pressurized.

30. The apparatus of claim 29 wherein the seal is pressurized by compressed air.

31. The apparatus of claim 25 wherein the liquid is water.

32. The apparatus of claim 25 wherein a plurality of the jet devices are disposed successively along the path.

33. The apparatus of claim 32 wherein the plurality of the jet devices are provided in the casing.

34. The apparatus of claim 33 wherein three jet devices are provided in the casing.

35. The apparatus of claim 32 wherein the plurality of the jet devices apply rotational forces to the product in the same direction.

36. The apparatus of claim 32 wherein two of the plurality of the jet devices apply rotational forces to the product in opposite directions.

37. The apparatus of claim 18 further including a feedback arrangement to control the manipulation of the product.

38. The apparatus of claim 37 wherein the feedback arrangement includes a measuring instrument to measure a property of the product and to produce a signal to control the manipulation of the product.

39. The apparatus of claim 38 wherein the signal controls the jet of liquid.

40. The apparatus of claim 38 wherein the signal controls a rate of passing the product through the jet device.

41. The apparatus of claim 18 further including a cooling apparatus that receives the product.

42. The apparatus of claim 41 wherein the cooling apparatus is the jet device.

43. The apparatus of claim 18 further including a winding apparatus disposed downstream of the jet device.

44. A method of applying false twist to a textile filament yarn comprising the steps of:

passing the yarn through a jet device having at least four openings and a bore with a longitudinal axis, and applying a rotational force to the yarn with at least one jet of liquid directed by the device at an oblique angle to the yarn, maintaining the yarn in generally coaxial alignment with the longitudinal axis of the bore and discharging the liquid from at least one of the openings.

45. The method of claim 44 further including the steps of applying a false twist to the yarn and cooling the yarn.

46. The method of claim 44 further including the steps of applying a false twist to the yarn and cooling the yarn with the jet device.

47. The method of claim 46 further including the step of heating the yarn prior to the steps of cooling the yarn and applying a twist to the yarn.

48. The method of claim 47 further including the steps of passing the yarn through a twist trap, then passing the yarn through a heating zone, then passing the yarn through a cooling zone and the jet device, and rotating the yarn by the jet device so that the twist runs back to the twist trap, and the yarn is then wound up.

49. The method of claim 48 further including the step of accomplishing the step of heating the yarn as far upstream as the twist trap.

50. The method of claim 48 further including the step of accomplishing the step of heating the yarn prior to the yarn entering the twist trap.

51. The method of claim 50 wherein the yarn is not heated between the twist trap and the jet device.

52. The method of claim 45 further including the step of drawing the yarn prior to the steps of cooling the yarn and applying a twist to the yarn.

53. The method of claim 44 further including the step of applying a forwarding force to the yarn.

54. The method of claim 44 further including the step of applying at least one axially offset jet of liquid to the surface of the yarn.

55. The method of claim 54 further including the step of directing the at least one jet of liquid to have components of velocity both along and laterally of the path through the device.

56. The method of claim 55 further comprising the step of applying a plurality of jets of liquid disposed about the path through the device.

57. The method of claim 55 further comprising the step of symmetrically disposing the plurality of jets about the path through the device.

58. The method of claim 56 further comprising the step of applying three jets of liquid symmetrically about the path through the device.

59. The method of claim 44 wherein the liquid is water.

60. The method of claim 45 further comprising the step of cooling the yarn by immersion in a cooling liquid within a cooling zone.

61. The method of claim 60 further comprising the step of moving the cooling liquid in a contraflow to a traveling direction of the yarn through the cooling zone.

62. The method of claim 60 wherein the cooling zone and the jet device are contiguous.

63. The method of claim 60 wherein the cooling liquid is the liquid directed by the jet device.

64. The method of claim 47 further comprising the step of heating the yarn by vapor.

65. The method of claim 64 further comprising the step of heating the yarn by superheated steam.

66. The method of claim 48 further comprising the step of post treating the yarn prior to the step of winding up the yarn.

67. The method of claim 66 further comprising the step of passing the yarn with controlled overfeed through a heating apparatus.

68. The method of claim 67 wherein the heating apparatus comprises a vapor heating apparatus.

69. The method of claim 68 wherein the vapor is superheated steam.

70. The method of claim 44 further comprising the steps of measuring a property of the false twisted yarn and using the measurement to control the method of manipulating the yarn.

71. The method of claim 44 further comprising the step of measuring a property of the false twisted yarn and using the measurement to control the rotational force applied to the yarn.

72. The method of claim 71 further comprising the step of using the measured property to control the at least one jet of liquid.

73. The method of claim 71 further comprising the step of using the measured property to control the passing the yarn along the path through the device.

74. The method of claim 70 further comprising the step of using the measured property to control the heating step.

75. An apparatus for applying false twist to a textile filament yarn comprising:

a jet device having at least four openings and a bore with a longitudinal axis, at least one jet of liquid directed by the device at an oblique angle to the yarn as the yarn passes through the device and maintained in generally coaxial alignment with the longitudinal axis of the bore, and at least one of the openings providing a dedicated liquid exhaust port and at least one of the other openings providing a dedicated liquid intake port.

76. The apparatus of claim 75 further including a cooling apparatus that cools the yarn.

77. The apparatus of claim 76 wherein the cooling apparatus is the jet device.

78. The apparatus of claim 76 further including a heating apparatus that heats the yarn.

79. The apparatus of claim 78 wherein the heating apparatus is upstream of the cooling apparatus.

80. The apparatus of claim 79 further including a heating apparatus, cooling apparatus, and liquid jet twisting device mounted in a common housing that receives the yarn.

81. The apparatus of claim 78 further including a winding apparatus disposed downstream of the jet device.

82. The apparatus of claim 76 further including a drawing apparatus for drawing the yarn.

83. The apparatus of claim 82 wherein the drawing apparatus is disposed upstream of the cooling apparatus.

84. The apparatus of claim 75 wherein the device directs the at least one jet of liquid axially offset to a surface of the yarn.

85. The apparatus of claim 75 wherein the device applies a forwarding force to the yarn as the yarn travels through the device.

86. The apparatus of claim 85 wherein the device directs the at least one jet of liquid to have components of velocity both along and laterally of the path through the device.

87. The apparatus of claim 84 wherein a plurality of jets of liquid are disposed about the path through the device.

88. The apparatus of claim 87 wherein the plurality of jets are symmetrically disposed about the path.

89. The apparatus of claim 88 wherein three jets are disposed symmetrically about the path.

90. The apparatus of claim 84 wherein the device includes a casing having an axial bore having an axis terminating in a yarn constricting outlet, the axis defining the path through the device, and at least one liquid flow channel aimed towards the outlet and offset from the axis.

91. The apparatus of claim 90 wherein the device includes a housing having at least one seal against liquid escape along the path.

92. The apparatus of claim 91 wherein the seal is a labyrinth seal.

93. The apparatus of claim 92 wherein the seal is pressurized.

94. The apparatus of claim 93 wherein the seal is gas pressurized.

95. The apparatus of claim 94 wherein the seal is pressurized by compressed air.

96. The apparatus of claim 84 wherein the liquid directed by the device is water.

97. The apparatus of claim 84 wherein a plurality of the jet devices are disposed successively along the path.

98. The apparatus of claim 97 wherein the plurality of the jet devices are provided in a casing.

99. The apparatus of claim 98 wherein three jet devices are provided in the casing.

100. The apparatus of claim 77 wherein the yarn cooling apparatus is a fluid cooling apparatus in which the yarn passes through a fluid to be cooled by heat transfer thereto.

101. The apparatus of claim 100 wherein the yarn cooling apparatus comprises a cooling chamber with a fluid inlet and a fluid outlet for cooling fluid passed therethrough, and a yarn inlet and yarn outlet.

102. The apparatus of claim 101 wherein the cooling fluid is passed contraflow relative to the yarn.

103. The apparatus of claim 101 wherein the cooling chamber comprises seals against escape of cooling fluid at the yarn inlet and the yarn outlet.

104. The apparatus of claim 103 wherein the seals are labyrinth seals.

105. The apparatus of claim 104 wherein the seals are pressurized.

106. The apparatus of claim 105 wherein the seals are gas pressurized.

107. The apparatus of claim 106 wherein the seals are pressurized by compressed air.

108. The apparatus of claim 100 wherein the cooling fluid is a liquid.

109. The apparatus of claim 108 wherein the cooling fluid is water.

110. The apparatus of claim 108 wherein the passing of liquid through the cooling chamber is arranged to be turbulent.

111. The apparatus of claim 108 wherein the jet device and the cooling apparatus have a common liquid.

112. The apparatus of claim 78 wherein the heating apparatus is a vapor heating apparatus.

113. The apparatus of claim 112 wherein the vapor is superheated steam.

114. The apparatus of claim 113 wherein the heating apparatus comprises a housing having seals against escape of steam at a yarn inlet and at a yarn outlet thereof.

115. The apparatus of claim 114 wherein the seals are labyrinth seals.

116. The apparatus of claim 115 wherein the seals are pressurized.

117. The apparatus of claim 116 wherein the seals are gas pressurized.

118. The apparatus of claim 117 wherein the seals are pressurized by compressed air.

119. The apparatus of claim 117 wherein the seals are pressurized by superheated steam.

120. The apparatus of claim 81 further comprising a treatment portion operable to post treat the yarn.

121. The apparatus of claim 120 further comprising a feed device operable to pass the yarn with controlled overfeed through a further heating apparatus.

122. The apparatus of claim 121 wherein the further heating apparatus comprises a vapor heating apparatus.

123. The apparatus of claim 122 wherein the heating apparatus and the further heating apparatus use a same vapor in sequence.

124. The apparatus of claim 81 further including a feedback arrangement to control the manipulation of the yarn.

125. The apparatus of claim 124 wherein the feedback arrangement includes a measuring instrument to measure a property of the false twisted yarn and to produce a signal in response thereto.

126. The apparatus of claim 125 wherein the signal controls the jet of liquid.

127. The apparatus of claim 125 wherein the signal controls a rate of passing the yarn through the jet device.

128. The apparatus of claim 125 wherein the signal controls a heating step.

* * * * *

UNITED STATES PATENT AND TRADEMARK OFFICE

CERTIFICATE OF CORRECTION

PATENT NO. : 6,438,934 B1
DATED : August 27, 2002
INVENTOR(S) : Peter William Foster et al.

It is certified that error appears in the above-identified patent and that said Letters Patent is hereby corrected as shown below:

Column 5,
Line 9, delete the word “thereof” and insert -- thereof. -- therefor.

Column 10,
Line 25, delete the word “seat” and insert -- seal -- therefor.

Signed and Sealed this

Twenty-fifth Day of May, 2004

JON W. DUDAS
*Acting Director of the United States Patent and Trademark Office*